US006685340B2

(12) United States Patent
Symonds

(10) Patent No.: US 6,685,340 B2
(45) Date of Patent: Feb. 3, 2004

(54) OUTDOOR DECORATION

(76) Inventor: Stephen M. Symonds, 72 Sawdust Ave., Kingston, NY (US) 12401

( * ) Notice: Subject to any disclaimer, the term of this patent is extended or adjusted under 35 U.S.C. 154(b) by 16 days.

(21) Appl. No.: 09/955,250

(22) Filed: Sep. 19, 2001

(65) Prior Publication Data

US 2003/0058644 A1 Mar. 27, 2003

(51) Int. Cl.[7] ..... F21S 4/00

(52) U.S. Cl. ..... 362/252; 362/227; 362/249; 362/806

(58) Field of Search ..... 362/227, 249, 362/252, 806, 457, 458, 121, 122, 123, 391; 40/442–444

(56) References Cited

U.S. PATENT DOCUMENTS 2,731,752 A 1/1956 Erickson et al. ..... 41/15
3,096,943 A * 7/1963 Forrer ..... 362/249
3,099,247 A 7/1963 Bieber ..... 119/15.5
3,154,457 A 10/1964 Ranoha ..... 161/22
4,092,801 A 6/1978 Schoenherr et al. ..... 47/41.12
5,235,780 A 8/1993 Colbert ..... 47/41.12
5,503,883 A 4/1996 Kell, Jr. et al. ..... 428/10
5,772,312 A * 6/1998 Pihl-Niederman et al. .. 362/249
5,850,927 A * 12/1998 Pan ..... 211/181.1
5,971,563 A * 10/1999 Maggio ..... 362/249
6,203,171 B1 * 3/2001 Sherman, Jr. ..... 362/249
6,419,373 B1 * 7/2002 Shieh ..... 362/249

* cited by examiner

*Primary Examiner*—Sandra O'Shea
*Assistant Examiner*—Bao Q. Truong

(57) ABSTRACT

An outdoor decoration, primarily intended for the holiday season, with a wire frame that is divided into segments, the segments having either the same size or with as many segments as possible having the same size, the segments not having the same size to be comparative in size, to permit fitting the segments together for convenient shipping. The segments are held together by clips and lights are placed on the frame.

12 Claims, 11 Drawing Sheets

OUTDOOR DECORATION

BACKGROUND OF THE INVENTION

1. Field of the Invention

This invention relates to decorations and more particularly to outdoor lighted decorations constructed on a wire frame.

2. Prior Art and Objects

Outdoor decorations are well known. The use of lights on various objects, oftentimes trees, is particularly popular at holidays. Some outdoor decorations must be large such as would be used on a large building but are frequently used with even modest one family homes. Decorations having a large size pose the difficulty of transporting the decoration which, with a large decoration of substantial size, is certainly expensive and would require special handling.

An outdoor decoration is provided, primarily for holiday usage, which is constructed on a wire frame. Designs of the frame which exemplify the invention include a wreath and a candy cane. The decoration may be made in any size but this invention is most applicable when used for a comparatively large outdoor decoration which pose problems for shipping. Such decorations, as, for example, with a wreath, can have a diameter of four feet and could be eight feet in diameter or more.

The Erickson Patent, U.S. Pat. No. 2,731,752 pertains to an artificial tree where layers are placed upon wire strings in a tapered cone arrangement. Each layer has an irregular doughnut shape and has an internal opening and an external perimeter which creates a frame on which wrapping can be placed. A light at the base of the wire strings shines light on the layers. The wire frames form with the wire strings an outdoor decoration. The Erickson Patent does not teach the construction of a unitary wire frame using a plurality of segments of either the same size or of a sufficiently similar size to permit placing the segments in a compact stack for shipping.

Therefore, it is an object of this invention to provide a large outdoor lighted decoration that is constructed in parts, preferable parts that are either the same or reasonably similar to one another and which fit together into a stack that is a comparatively small package for shipping.

It is a further object of the invention to provide an outdoor lighted decoration that can be easily assembled.

It is still another object of the present invention to provide lights that are prearranged to be readily placed upon the outdoor decoration and secured to it.

It is still another object to provide an outdoor decoration which is three dimensional and which provides a special three dimensional appearance.

These and other objects will be apparent to those skilled in the art based upon the description of the preferred embodiment.

SUMMARY OF THE INVENTION

An outdoor decoration is provided, primarily for holiday usage, which is constructed on a wire frame. The wire frame is three dimensional and has a generally rounded cross section. The frame is separated into a generally equal front section and a rear section, in essence along its center plane. The front section and the rear section are mirror images of one another. Both the front section and the rear section are divided into an equal number of segments, preferable which each segment either being the same size, which is feasible for a wreath or reasonably similar with a candy cane. With a candy cane, it is not possible for all the parts to have the same size and shape but the parts can be restricted to three different shapes at least having a similar size which do readily fit together for easy shipping. The various parts are readily clipped together into a strong structure. Lights may be placed upon the frame in any number of ways such as by wrapping a series of strands of lights about the frame. However, by constructing a preformed blanket of lights that can be placed separately on the front section and the rear section of the wire frame and then held together and to the wire frame by a retaining means, ease of installation of the lights is very much enhanced and a specific appearance is more readily assured.

| NUMERAL | DESCRIPTION |
|---|---|
| 21 | Wire Frame |
| 23 | Half Sections |
| 25 | Semicircular Cross-Section |
| 27 | Front Section |
| 29 | Rear Section |
| 31 | Segments |

-continued

| NUMERAL | DESCRIPTION |
|---|---|
| 33 | Shaft - Candy Cane |
| 35 | Handle - Candy Cane |
| 37 | Inside Segment - Front Section - Handle |
| 39 | Outside Segment - Rear Section - Handle |
| 41 | Inside Segment - Rear Section - Handle |
| 43 | Outside Segment - Front Section - Handle |
| 45 | Longitudinal Wire Members |
| 47 | Cross Wire Members |
| 48 | Clip Means and Retainer Means |
| 49 | Lights |
| 51 | Mats |
| 53 | Inner Circle |
| 55 | Outer Circle |
| 57 | Strands |
| 59 | Structural Cords |
| 61 | Electrical Leads |
| 63 | Transformer |
| 65 | Openings |

DESCRIPTION OF THE PREFERRED EMBODIMENT

Figure 1:
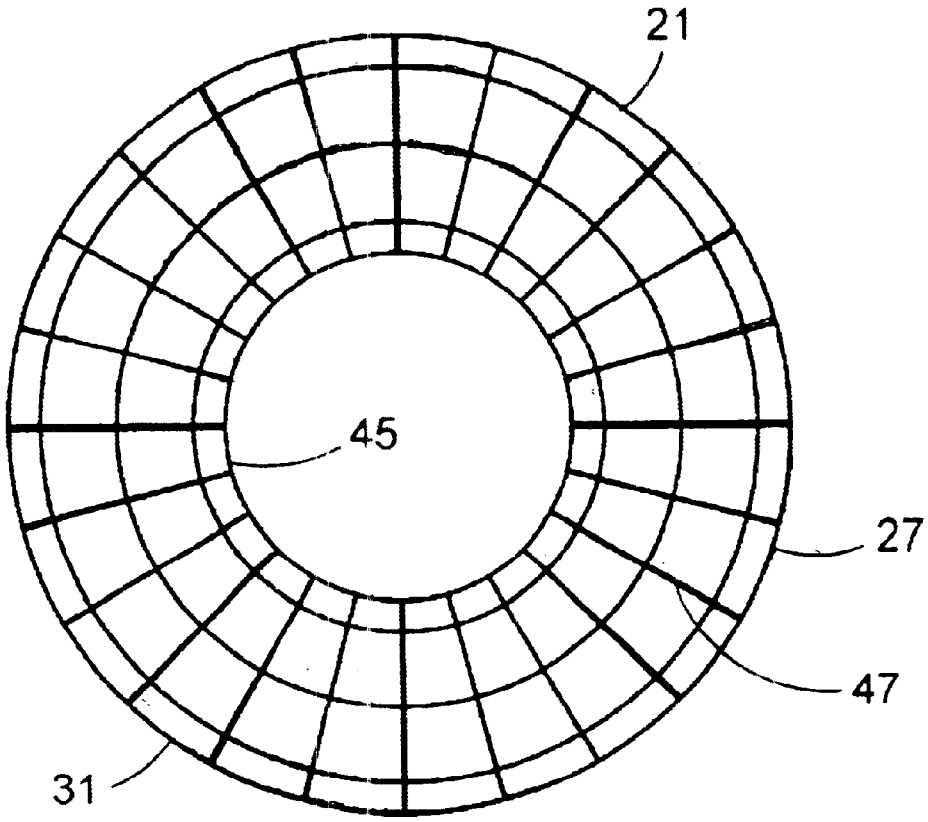
FIG. 1 is plan view of a wire frame for use as a decoration in the shape of a wreath.
Figure 2:
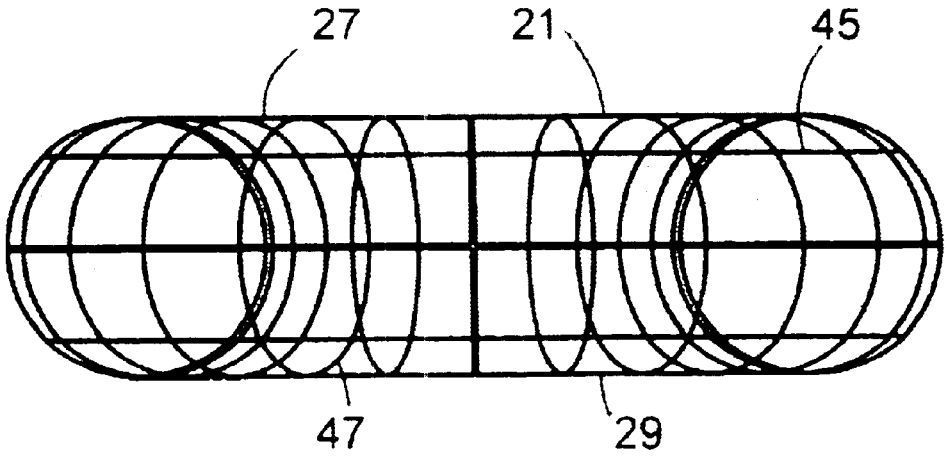
FIG. 2 is a side elevation of the wire frame shown in FIG. 1.
Figure 3:
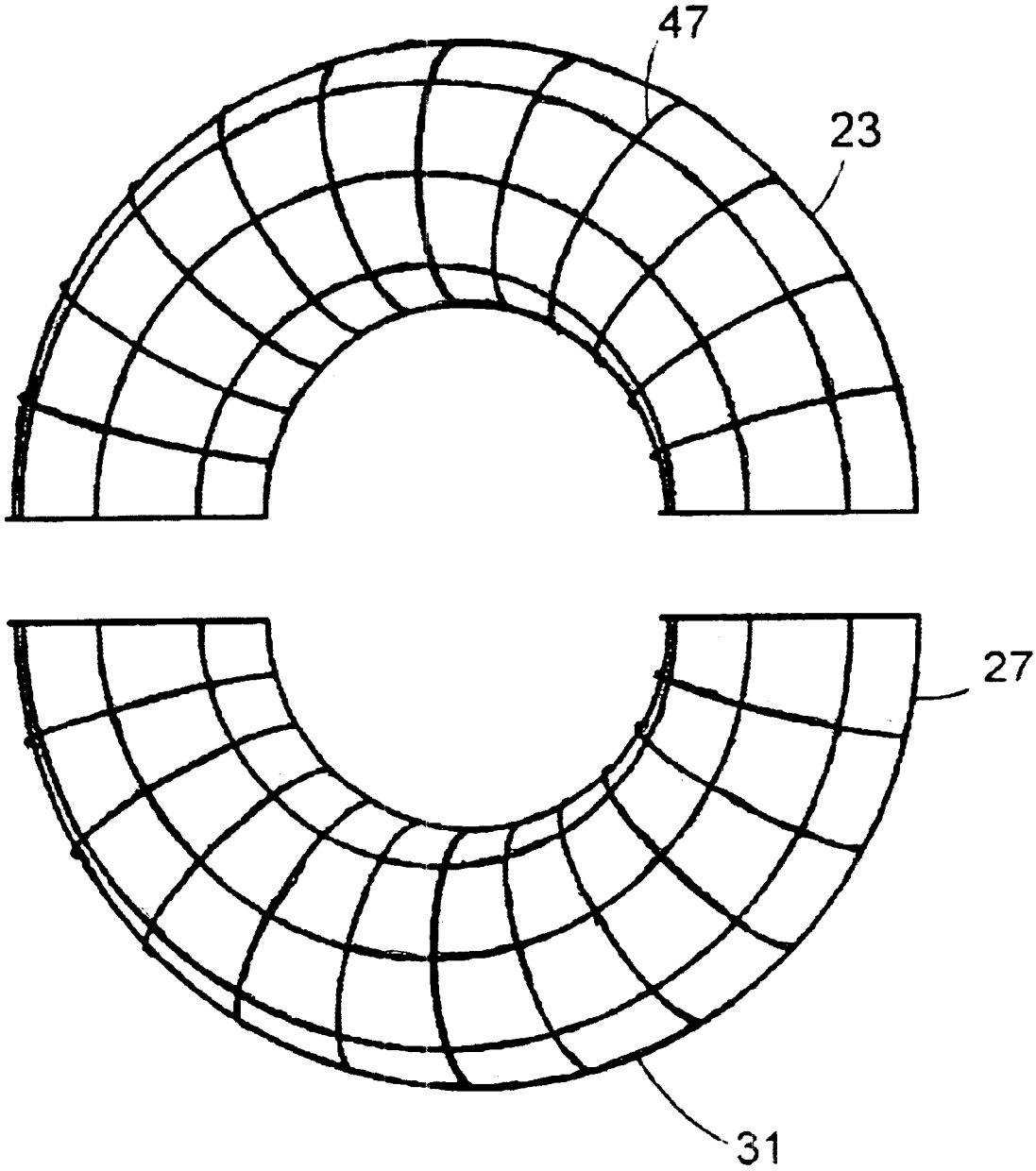
FIG. 3 is a pictorial view of the wreath shown in FIG. 1 showing a half section of the wire frame separated along the central plane of the wire frame with the half section separated into two segments.
Figure 4:
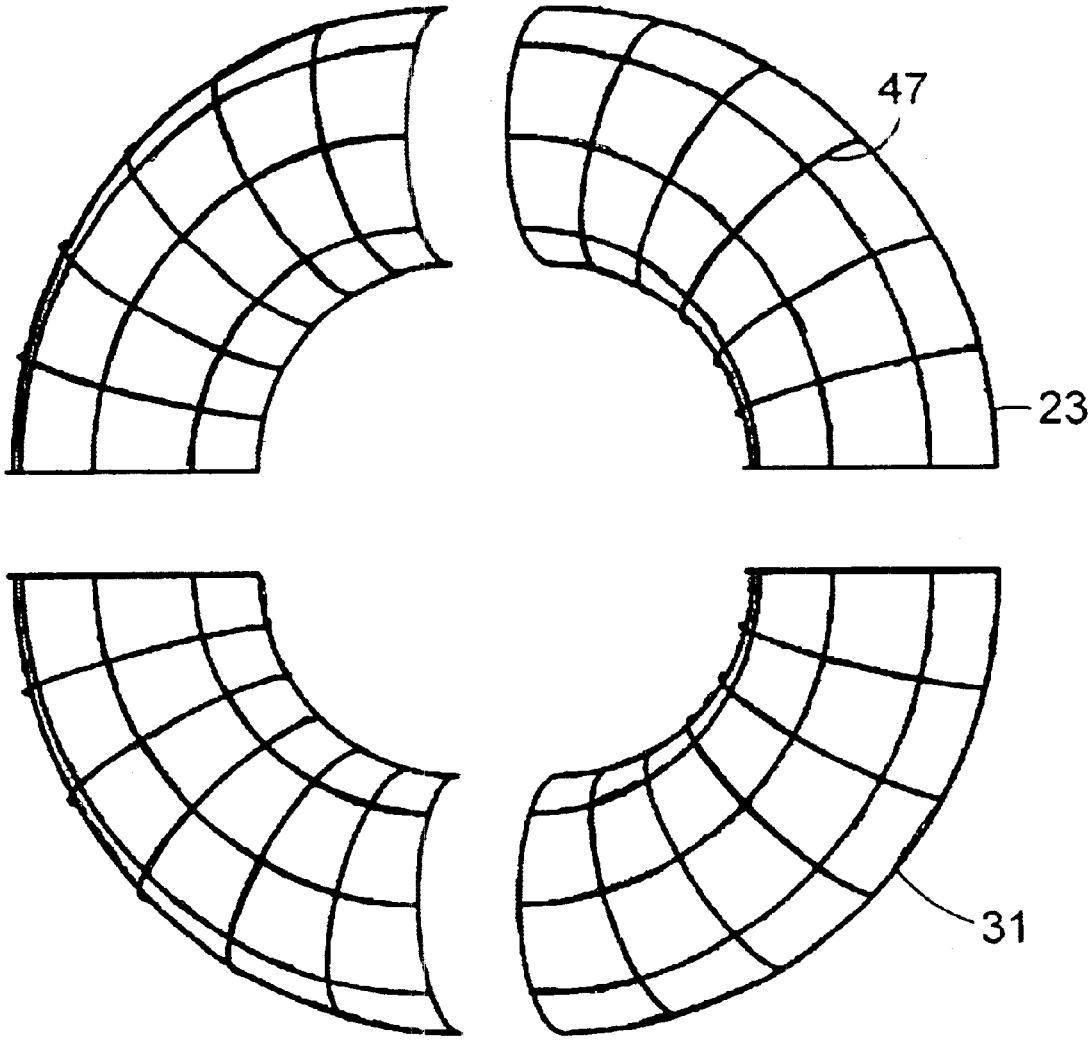
FIG. 4 is a pictorial view similar to FIG. 3 of one of the half sections divided into four equal segments.
Figure 5:
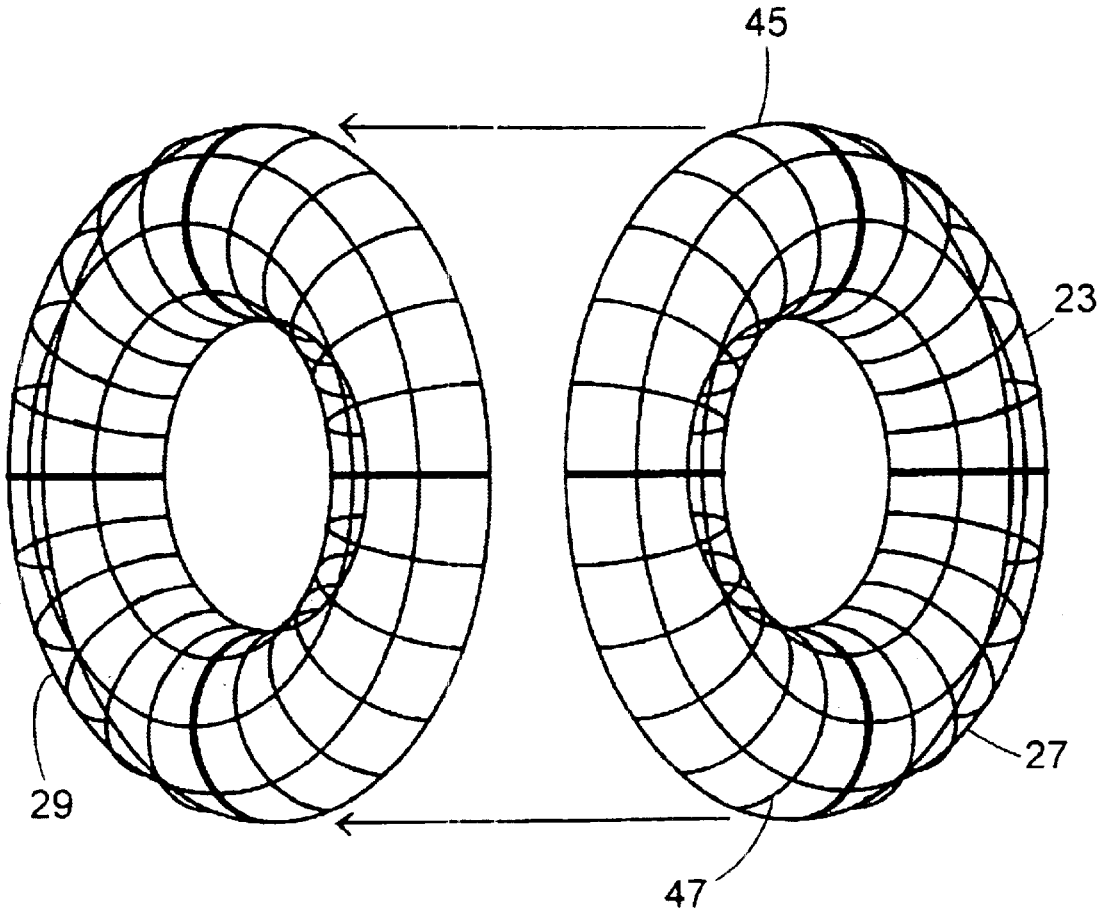
FIG. 5 is a pictorial view of a wire frame used for a decoration as a wreath but with both halfs shown separated from one another.

Referring to FIGS. 1 through 4, a wire frame 21 is shown for a wreath to be used as an outdoor decoration. Such a wire frame 21 can be built as one piece but, outdoor decorations, have a substantial size. As a result, unless the wreath is being used where it is constructed, shipment of the wreath for any distance is difficult and most certainly expensive. In FIGS. 3 and 4, the wire frame 21 for the wreath is shown separated along its central plane resulting in two half sections 23, each having a substantially semicircular cross section 25. The two half sections 23, namely a front section 27 and a rear section 29, are mirror images of one another. Each half section 23 is then divided into equal segments. As best seen in FIG. 3, one half section 23 is divided into segments 31, FIG. 3 showing two equal segments 31. In FIG. 4, one half section 23 is divided into four equal segments 31. When the two half sections 23 are each divided into four segments 31, the entire wire frame 21 is broken down into eight equal segments 31. The selection of four segments 31 for each half section 23 might be appropriate for a four foot wreath but the number of segments 31 may be increased, or as shown in FIG. 3, even decreased. The use of six or eight segments 31 is perfectly acceptable and is to be anticipated with larger decorations.

Figure 9:
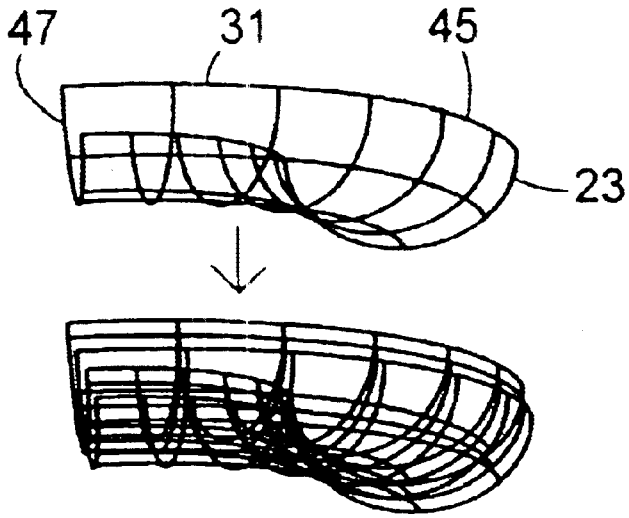
FIG. 9 is a pictorial view showing of the segments of a wreath depicted in FIG. 4 being stacked for packaging.

Since with a wreath, each segment 31 has the same shape and the same size, all eight segments 31 fit together readily, as is shown in FIG. 9. This results in a compact package for shipping. If there were twelve or sixteen segments 31, the result would be the same but with a reasonably larger and heavier package.

Figure 6:
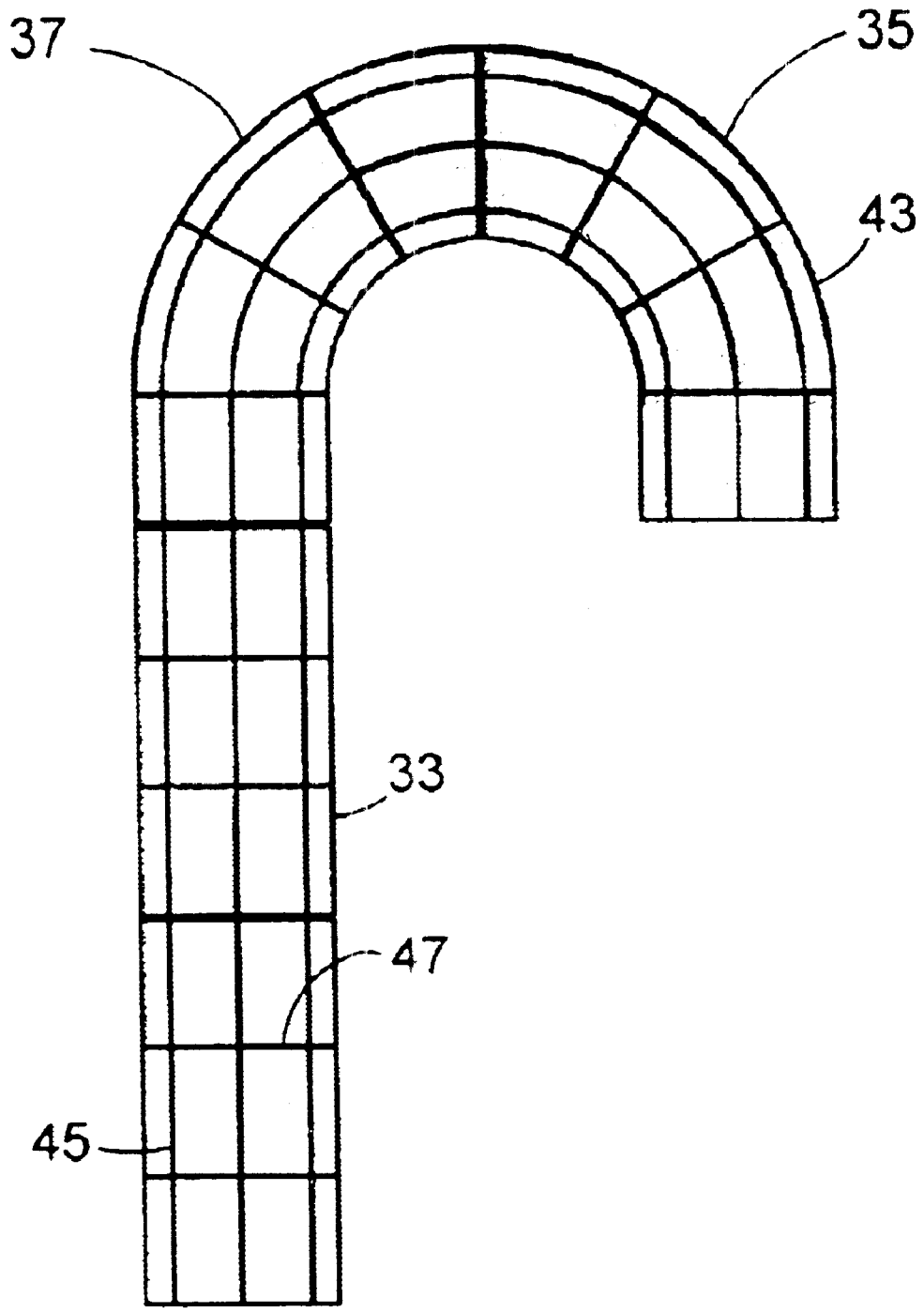
FIG. 6 is a side elevation of the wire frame for use as a decoration in the shape of a candy cane.
Figure 10:
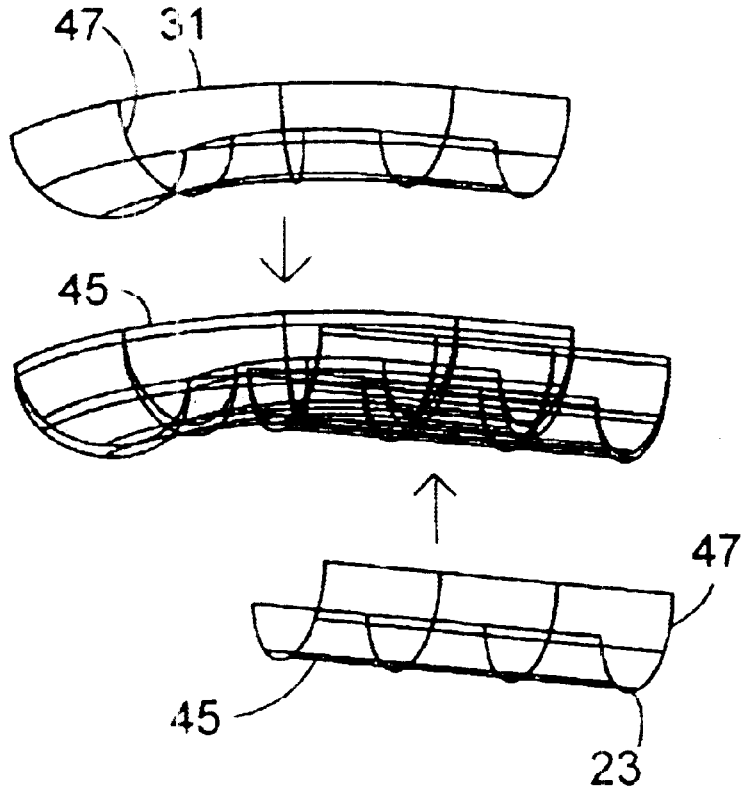
FIG. 10 is a pictorial view showing the segments depicted in FIG. 8 being stacked for packaging.

Since a wreath is symmetrical, it is easily capable of being divided into equal segments 31 but this is not possible with a irregularly shaped design such as a candy cane which is shown in FIG. 6. However, with careful planning, the number of shapes can be kept to a minimum resulting in segments 31 that can be readily put together for shipment. The result with a candy cane, as shown in FIGS. 6, 7, 8 and 10, is segmnet 31 with three different shapes and a total of eight segments 31. As shown in FIG. 10, the eight segments 31, readily fit together to form a reasonably compact package. Although the segments 31 shown in FIG. 10 have varying lengths, they are still capable of being readily stacked for easy shipment and storage.

Figure 8:
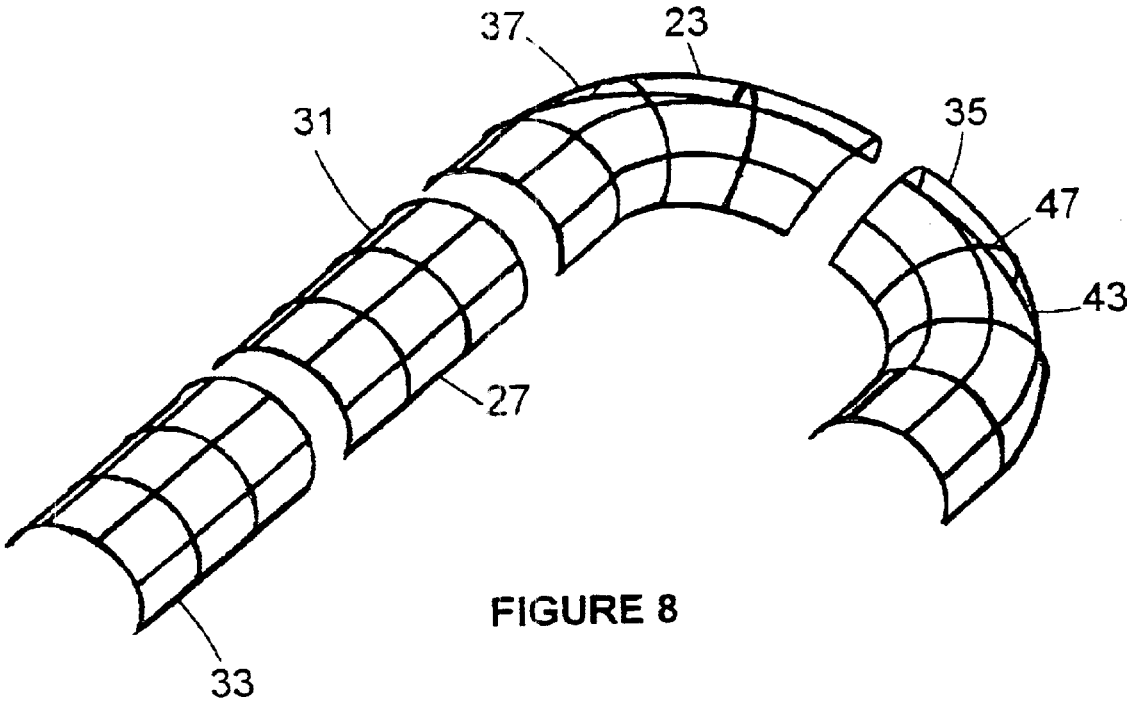
FIG. 8 is a pictorial view of one of the two halves of the wire frame shown in FIGS. 6 and 7 which has been divided into four segments.

A candy cane has two basic parts, namely a shaft 33, which is straight and elongated, and the handle 35 which is bent around roughly in a U-shape. Actually a true U-shape does not provide the best appearance and the handle 35 is best a little over bent as can be seen in FIG. 6. The shaft 33 can be divided into an equal number of segments 31. In FIG. 8, the front section 27 of the shaft 33 is shown divided into two equal segments 31. The rear section 29 is a mirror image of the front section 27. This results in the shaft 33 having four equal segments 31. The front section 27 and the rear section 29 of the handle 35 are both also separated into two segments 31 which results in a total of four segments 31 for the handle 35. However, the inside segment 37 of the handle 35 in the front section 27, which is connected to the shaft 33, is the same as the outside segment 39 in the rear section 29 of the handle 35 remote from the shaft 33. Similarly, the inside segment 41 of the rear section 29 which is connected to the shaft 35 is the same as the outside segment 43 of the front section 27. As a result, the handle 35 has four segments 31 but with only two different shapes. The shaft 33 has four segments 31 each with the same shape but distinctive from the shape of the segments 31 in the handle 35. The result is a total of eight segments 31 having three different shapes, as previously stated, for the entire wire frame 21 of a candy cane.

Figure 7:
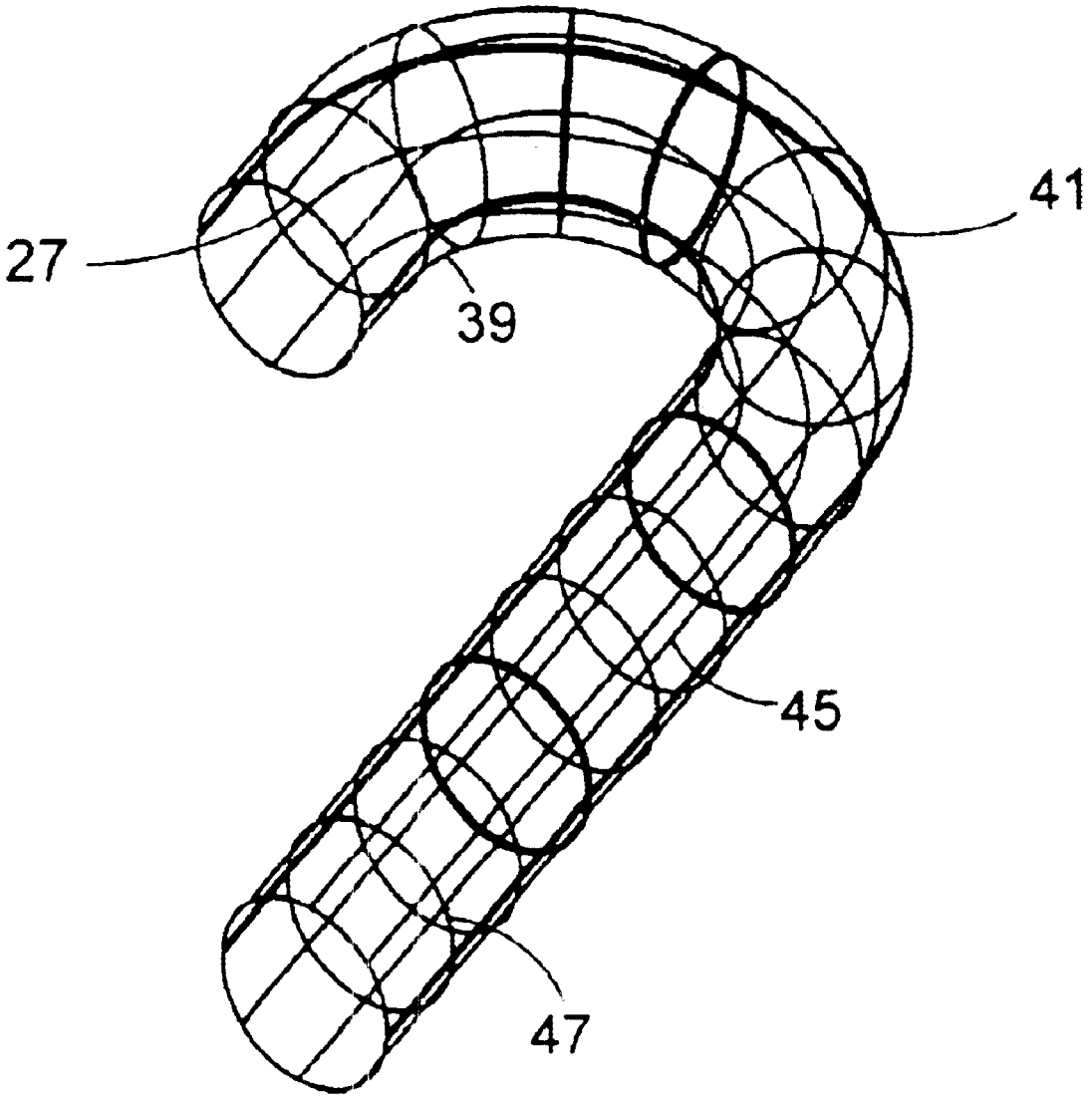
FIG. 7 is a pictorial view of the wire frame shown in FIG. 6.

With both the wreath, as shown in FIGS. 1 through 5 and the candy cane as shown in FIGS. 6 through 8, each segment 31 has longitudinal wire members 45 extending longitudinally along the segments 31 and cross wire members 47 which cross the longitudinal wire members 45. The longitudinal wire members 45 and the cross wire members 47 are fused to one another at the points at which they cross.

In assembling a wire frame 21 at the site where it is to be displayed, the segments 31 are secured by any form of suitable clip means 48. Actually, even tying with string or thin wire would be satisfactory. The wire members 45,47 of the segments 31 is placed into the clip means 48 and thereby secured. By opening or cutting the clip means 48, the segments 31 are readily separated and can be again stacked as shown in FIGS. 9 and 10. The clip means 48 is also the retainer means 48 as referred to hereinafter.

Figure 12:
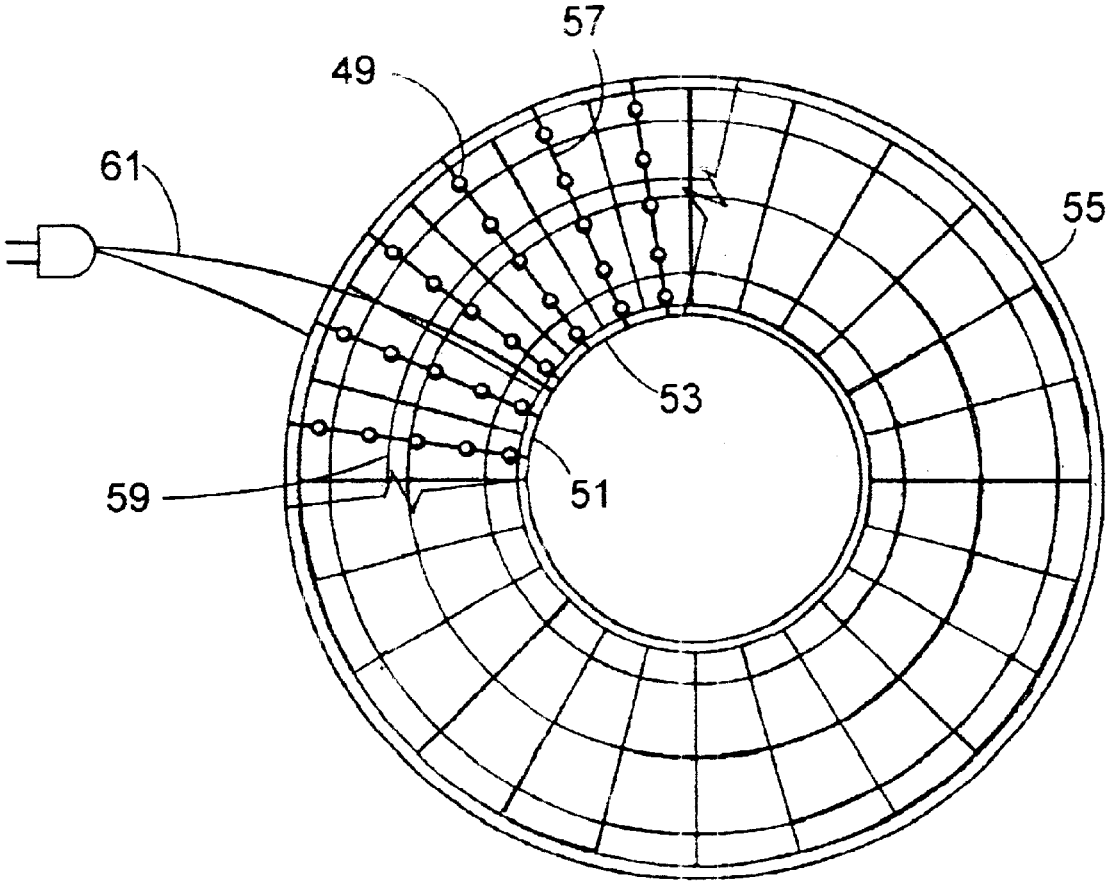
FIG. 12 is a plan view of a mat of electrical wiring with lights used to cover a portion of the wire frame shown in FIGS. 1 and 2.
Figure 13:
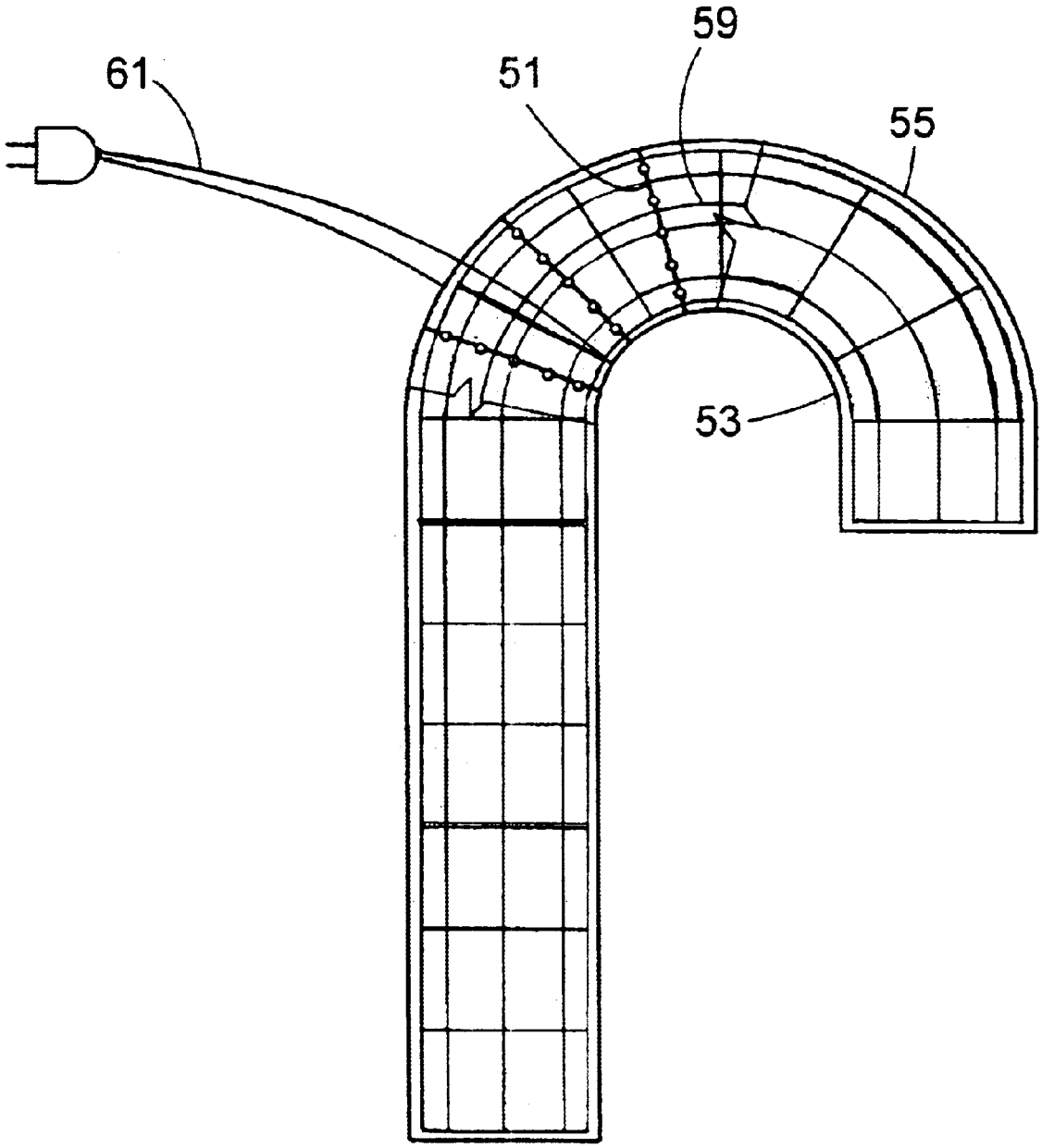
FIG. 13 is a pictorial view of the wreath shown in FIGS. 1 and 2 with the lights installed.

Once the wire frame 21 is assembled, lights 49 need to be placed on the wire frame 21 to produce the unusual and the highly attractive three dimensional appearance. As best seen in FIG. 12, the lights 49 for a wreath, are formed in a mat 51 about an inner circle 53 and an outer circle 55, both the inner circle or inner electrical lead 53 and the outer circle or outer electrical lead 55 being electric lines. Strands 57 extend between and are connected to both the outer circle 55 and the inner circle 53. A structural cord 59, which does not carry electrical power, serves to space the strands 57. Electrical power is supplied by electrical leads 61 to the inner circle 53 and to the outer circle 55. Lights 49 are mounted on the strands 57 in electrical series with one another. The individual strands 57 are electrically in parallel to one another.

Figure 11:
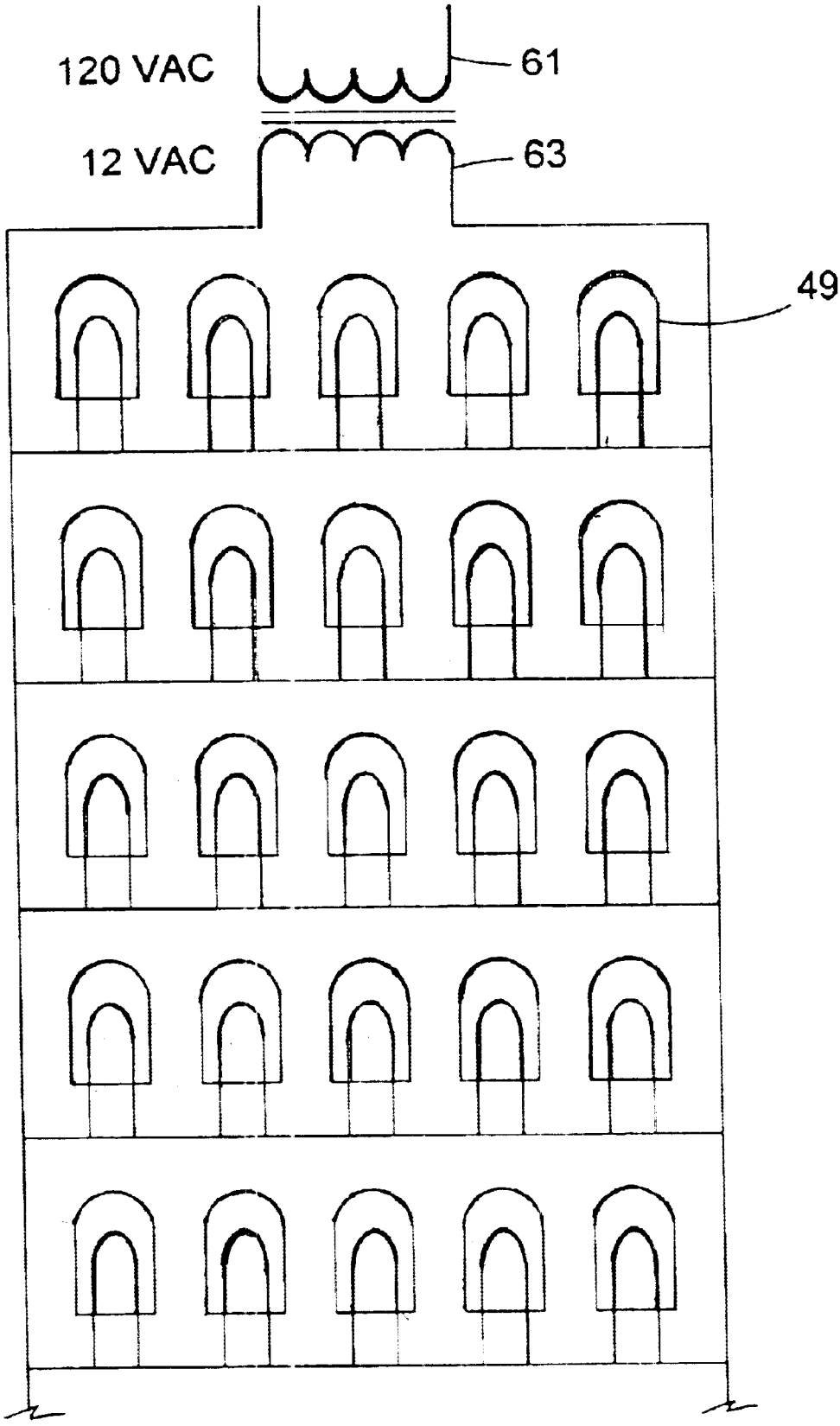
FIG. 11 is a schematic view of the electrical circuitry to be used in the lighting of the outdoor decorations.

The details of the electrical circuitry are shown in FIG. 11 while the physical arrangement of the mat 51 is shown in FIG. 12. A transformer 63 is used to step down the usually available one hundred twenty volt power to twelve volts. Alternatively, five lights 49 and four lights 49 are placed on strands 57, which strands 57 are electrically in parallel with one another. The lights 49 in any one strand 57 are in series with one another. In this way, the burning out of one light 49 will extinguish the strand in which that light 49 is located but at most only five lights 49 need be checked to correct the situation. The alternating pattern of five lights 49 and four lights 49 shown in FIG. 11 continues to a total of twenty eight strands with five lights 49 and twenty seven strands with four lights 49.

By shaping the mat 51 (FIG. 12) to the size and shape of a half section 23 of a wire frame 21, two mats 51 of lights 49 are needed to cover the entire wire frame 21 of a decoration. With a candy cane or any other shaped decoration, the same concept is used to form a mat 51 that covers a half section 23 of the decoration and with two mats 51 the entire wire frame 21 is covered. The inner circle 53 and the outer circle 55 are replaced by the inside and outside lines of the candy cane.

Figure 8A:
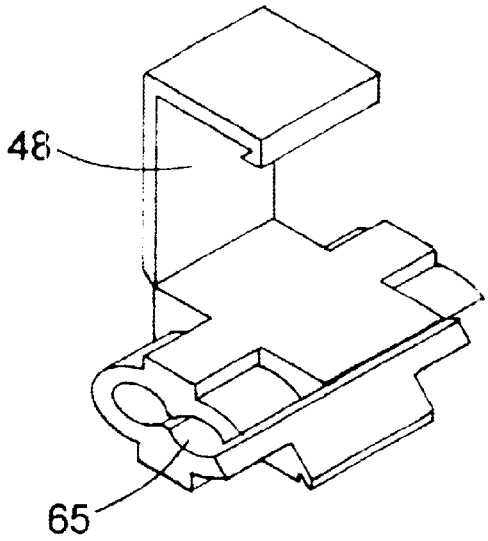
FIG. 8A is a pictorial view of the clip means and the retaineer means, the two means being identical, in the open position.
Figure 8B:
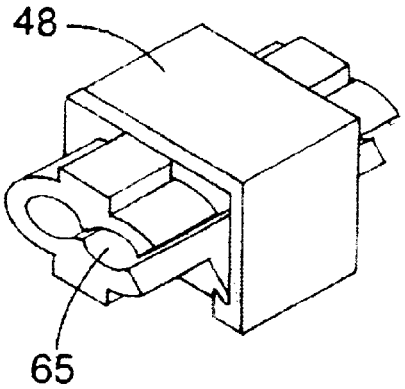
FIG. 8B is a pictorial view of the clip means and the retainer means in the closed position.

The mats 51 are connected to one another and to the wire frame 21 by retainer means 48 which are identical to the clip means 48 as previously mentioned. The clip means or retainer means 48, depending upon how it is used is commercially available and is commercially used for retaining wires together in automobiles. As best seen in FIG. 8A and FIG. 8B, the wire frame 21 and electrical leads 61 are secured in the openings 65. The clip means or retaining means 48 may, however, be as simple as a piece of string or one of many other possible devices.

The decoration in the form of a wreath is shown in FIG. 14 with the lights installed. The three dimensional effect of the lights on the rear section shining through the lights on the front section creates a very unusual and attractive appearance not known in previous decorations. The use of half sections 23 and segments 31 illuminated by two mats 51 of lights 49 is equally as applicable to wire frames 21 having various configurations other than a wreath and a candy cane.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. An outdoor decoration that is a three-dimensional and that can be assembled and disassembled, such outdoor decoration comprising:

a wire frame that is three dimensional and is formed in a front section and a rear section along the central plane of the wire frame, the front section and the rear section being mirror images of one another, both the front section and rear section being divided into segments, each segment having a size at least sufficiently similar to the size of the other segments to permit the segments to be stacked together for shipping and storage, the wire frame further including longitundinal wire members and cross wire members, the longitudinal wire members and the cross wire members being fused to one another;

a clip means for holding the segments and the front and rear sections together; and electric lights mounted on the frame.

2. An outdoor decoration according to claim 1 wherein the electric lights are a pair of mats of electric lights, each of the pairs of mats of electrical lights having a shape and size similar to the front section and rear section, one of the pair of mats to be placed on the front section and the other mat to be placed on the rear section and further including retaining means to hold the pair of mats to the front section and the to the rear section.

3. An outdoor decoration according to claim 1 wherein each segment has a generally semi-circular cross section.

4. An outdoor decoration that is three dimensional and that can be assembled and disassembled for storage and transportation, such outdoor decoration comprising:

a wire frame that is three dimensional in the shape of a decorative wreath, the wire frame being constructed with a separate front section and into a separate rear section along a central plane, the front section and the rear section being mirror images of one another, both the front section and the rear section being divided radially into substantially equal segments, the wire frame including longitudinal wire members and cross wire members, each segment having generally a semi circular cross section, the longitudinal wire members and the cross wire members being fused to one another;

a clip means for holding the segments and the front and rear sections together as a unitary frame; and a plurality of lights to encompass the wire frame.

5. An outdoor decoration according to claim 4 wherein the plurality of lights includes:

a pair of mats of electric lights having the shape of a wreath and each adapted to cover the front section and the rear section; and a retaining means to hold the pair of mats to the front section and the rear section.

6. An outdoor decoration according to claim 4 wherein the plurality of lights includes:

a pair of mats of electric lights having the shape of a wreath and each adapted to cover the front section and the rear section; and a retaining means to hold the pair of mats to the front section and the rear section, each mat including a plurality of strands with at least four lights in series, each of the strands being in parallel to the other strands.

7. An outdoor decoration according to claim 4 wherein the plurality of lights includes:

a pair of mats of electric lights having the shape of a wreath and each adapted to cover the front section and the rear section; and a retaining means to hold the pair of mats to the front section and the rear section, each mat including a plurality of strands with at least four lights in series, each of the strands being in parallel to the other strands, each mat being supplied with alternating electrical power of approximately one hundred twenty volts and including a transformer to step down the voltage to approximately one tenth of the voltage sujppied to the transformer.

8. An outdoor decoration that is three dimensional and that can be assembled and disassembled for storage and transportation, such outdoor decoration comprising:

a wire frame that is three dimensional in the shape of a decorative candy cane, the wire frame being constructed into a separate front section and a separate rear section along a central plane, the front section and the rear section being mirror images of one another, the candy cane including a shaft portion and a handle portion, the shaft portion of both the front section and the rear section each being constructed with at least two equal segments, the handle portion being divided into two different segments for the front section and into two different segments for the rear section, the two segments of the front section of the handle being substantially the same as the two segments of the rear section, the wire frame further including longitundinal wire members and cross wire members, the longitudinal wire members and the cross wire members being fused to one another;

a clip means for holding the segments and the front and rear sections together as a unitary frame; and a plurality of lights to encompass the wire frame.

9. An outdoor decoration according to claim 8 wherein the plurality of lights includes:

a pair of mats of electric lights having the shape of a candy cane and each adapted to cover the front section and the rear section; and a retaining means to hold the pair of mats to the front section and the rear section.

10. A mat of electrical lights for covering one half of a wire frame having an outer configuration and an inner configuration and used for an outdoor decoration, said mat comprising:

an outer electrical lead generally having the same configuration as the outer configuration of the outdoor decoration;

an inner electrical lead generally having the same configuration as the inner configuration of the outdoor decoration;

strands extending between and connected to both the outer electrical lead and to the inner electrical lead;

lights mounted on the strands; and a structural cord to space the electrical cords.

11. A mat according to claim 10 wherein the configuration of the outer electrical lead and the inner electrical lead is the configuration of a candy cane.

12. A mat according to claim 10 wherein the configuration of the outer electrical lead and the inner electrical lead is the configuration of a wreath.

* * * * *